US006674407B1

(12) United States Patent
Lowe

(10) Patent No.: US 6,674,407 B1
(45) Date of Patent: Jan. 6, 2004

(54) LASER BEAM FREQUENCY COLLECTION DEVICE

(76) Inventor: David Lowe, 3610 Chesapeake Ave., Los Angeles, CA (US) 90016

( * ) Notice: Subject to any disclaimer, the term of this patent is extended or adjusted under 35 U.S.C. 154(b) by 0 days.

(21) Appl. No.: 09/572,805

(22) Filed: May 17, 2000

Related U.S. Application Data

(60) Provisional application No. 60/136,339, filed on May 28, 1999.

(51) Int. Cl.[7] ..... H01Q 1/26
(52) U.S. Cl. ..... 343/701
(58) Field of Search ..... 343/701, 711, 343/713, 720, 721, 894, 897, 898; H01Q 1/26

(56) References Cited

U.S. PATENT DOCUMENTS

RE32,626 E * 3/1988 Yoshizawa et al. ..... 215/39
5,148,182 A * 9/1992 Gautier et al. ..... 343/701
6,438,391 B1 * 8/2002 Wang ..... 343/701

* cited by examiner

*Primary Examiner*—Hoanganh Le
(74) *Attorney, Agent, or Firm*—Goldstein Law Offices, P.C.

(57) ABSTRACT

A laser beam frequency collection device including an emitting unit secured to a house or a vehicle. The emitting unit is in communication with an electronic medium disposed within the house or vehicle. The emitting unit generates a laser beam for projecting outwardly therefrom. A collection grid is interposed in the path of the beam, the collection grid has a metal mesh and an output lead, collects electromagnetic energy from the beam, and provides an electromagnetic signal at the output lead. The laser beam collects radio frequency energy for use by the electronic medium.

3 Claims, 3 Drawing Sheets

LASER BEAM FREQUENCY COLLECTION DEVICE

CROSS REFERENCES AND RELATED SUBJECT MATTER

This application relates to subject matter contained in provisional patent application Ser. No. 60/136,339, filed in the United States Patent & Trademark Office on May 28, 1999.

BACKGROUND OF THE INVENTION

The present invention relates to a laser beam frequency collection device and more particularly pertains to collecting radio frequency energy to allow for radio, televisions, and cellular telephones to function.

Typically, when a radio, television, cellular telephone or the like is used, an antenna is required in order to pick up the electromagnetic signals that are transmitted from a radio or television station, or from a cellular telephone transmitter. These antennas are often unsightly, and are also subject to being damaged. Radio antennas and cellular antennas, for automobiles, project upwardly from the autos and can be easily broken with even moderate contact. Radio antennas, from transistors or "boom boxes", are usually manually manipulated in order to pick up a signal. This constant movement risks the breaking of the antenna. The use of antennas on houses, although not used as frequently due to cable television, are extremely unsightly. What is needed is a way to receive these signals without having to resort to the use of antennas.

The present invention seeks to solve the abovementioned problem by providing a laser device that will collect these frequencies for proper usage by these mediums.

The use of antennas is known in the prior art. More specifically, antennas heretofore devised and utilized for the purpose of collecting radio frequencies are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a laser beam frequency collection device for collecting radio frequency energy to allow for radio, televisions, and cellular telephones to function.

In this respect, the laser beam frequency collection device according to the present invention substantially departs from the conventional concepts and designs of the prior art, and in doing so provides an apparatus primarily developed for the purpose of collecting radio frequency energy to allow for radio, televisions, and cellular telephones to function.

Therefore, it can be appreciated that there exists a continuing need for new and improved laser beam frequency collection device which can be used for collecting radio frequency energy to allow for radio, televisions, and cellular telephones to function. In this regard, the present invention substantially fulfills this need.

SUMMARY OF THE INVENTION

In the view of the foregoing disadvantages inherent in the known types of antennas now present in the prior art, the present invention provides an improved laser beam frequency collection device. As such, the general purpose of the present invention, which will be described subsequently in greater detail, is to provide a new and improved laser beam frequency collection device and method which has all the advantages of the prior art and none of the disadvantages.

To attain this, the present invention essentially comprises an emitting unit secured to a house or a vehicle. The emitting unit is in communication with an electronic medium disposed within the house or vehicle. The emitting unit generates a laser beam for projecting outwardly therefrom. The laser beam collects radio frequency energy for properly operating the electronic medium. The radio frequency energy is picked up by a collection grid which is electriclaly connected to the electronic medium.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser beam frequency collection device which has all the advantages of the prior art antennas and none of the disadvantages.

It is another object of the present invention to provide a new and improved laser beam frequency collection device which may be easily and efficiently manufactured and marketed.

It is a further object of the present invention to provide a new and improved laser beam frequency collection device which is of durable and reliable construction.

An even further object of the present invention is to provide a new and improved laser beam frequency collection device which is susceptible of a low cost of manufacture with regard to both materials and labor, and which accordingly is then susceptible of low prices of sale to the consuming public, thereby making such a laser beam frequency collection device economically available to the buying public.

Even still another object of the present invention is to provide a new and improved laser beam frequency collection device for collecting radio frequency energy to allow for radio, televisions, and cellular telephones to function.

Lastly, it is an object of the present invention to provide a new and improved laser beam frequency collection device including an emitting unit secured to a house or a vehicle. The emitting unit is in communication with an electronic medium disposed within the house or vehicle. The emitting unit generates a laser beam for projecting outwardly therefrom. The laser beam collects radio frequency energy with a collection grid disposed around the beam, for supplying a radio frequency signal to the electronic medium.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved laser beam frequency collection device embodying the principles and concepts of the present invention and generally designated by the reference number 10 will be described.

Specifically, it will be noted in the various Figures that the device relates to a laser beam frequency collection device for collecting radio frequency energy to allow for radio, televisions, and cellular telephones to function.

Figure 1:
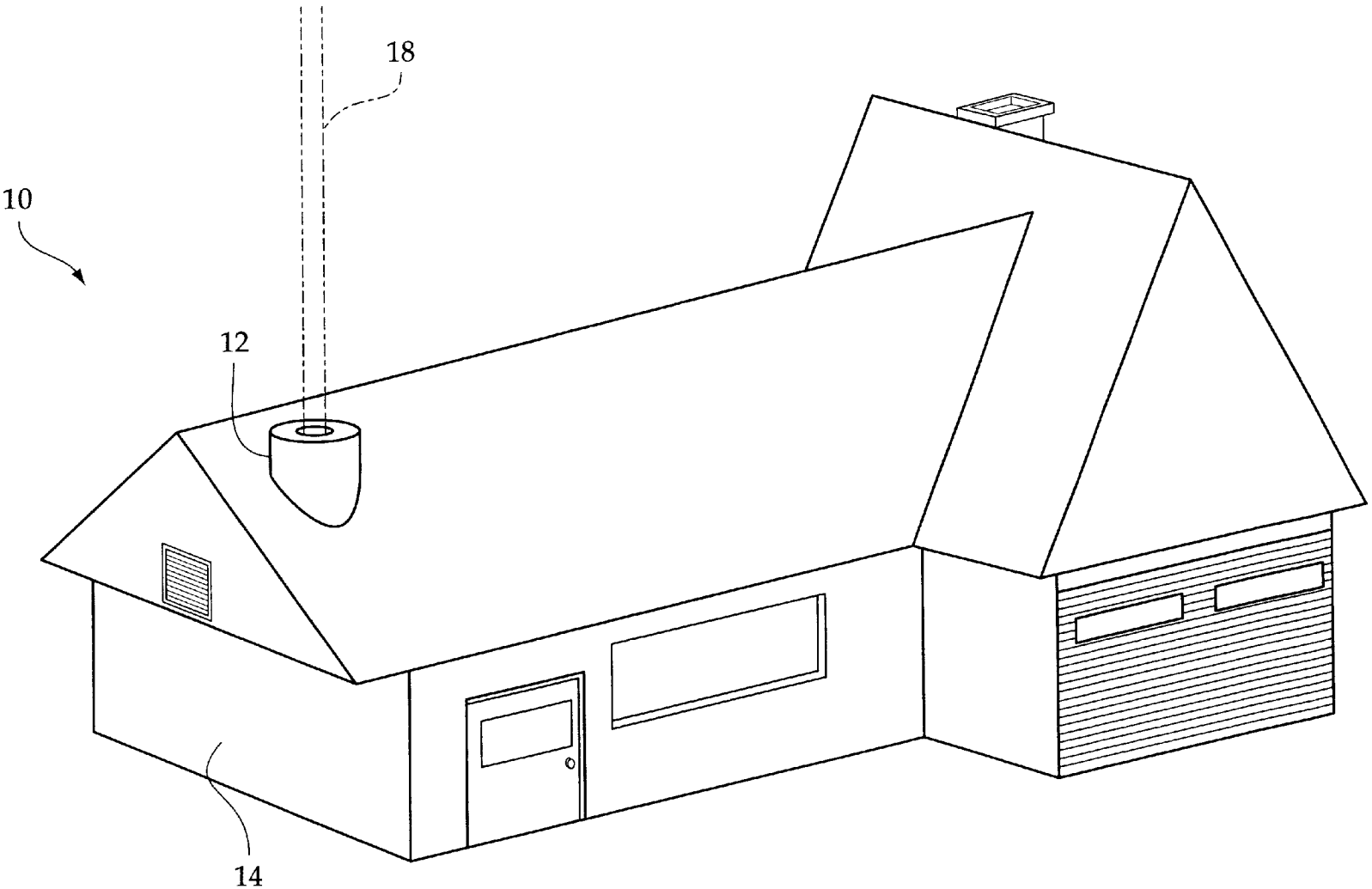
FIG. 1 is a perspective view of the preferred embodiment of the laser beam frequency collection device constructed in accordance with the principles of the present invention.
Figure 2:
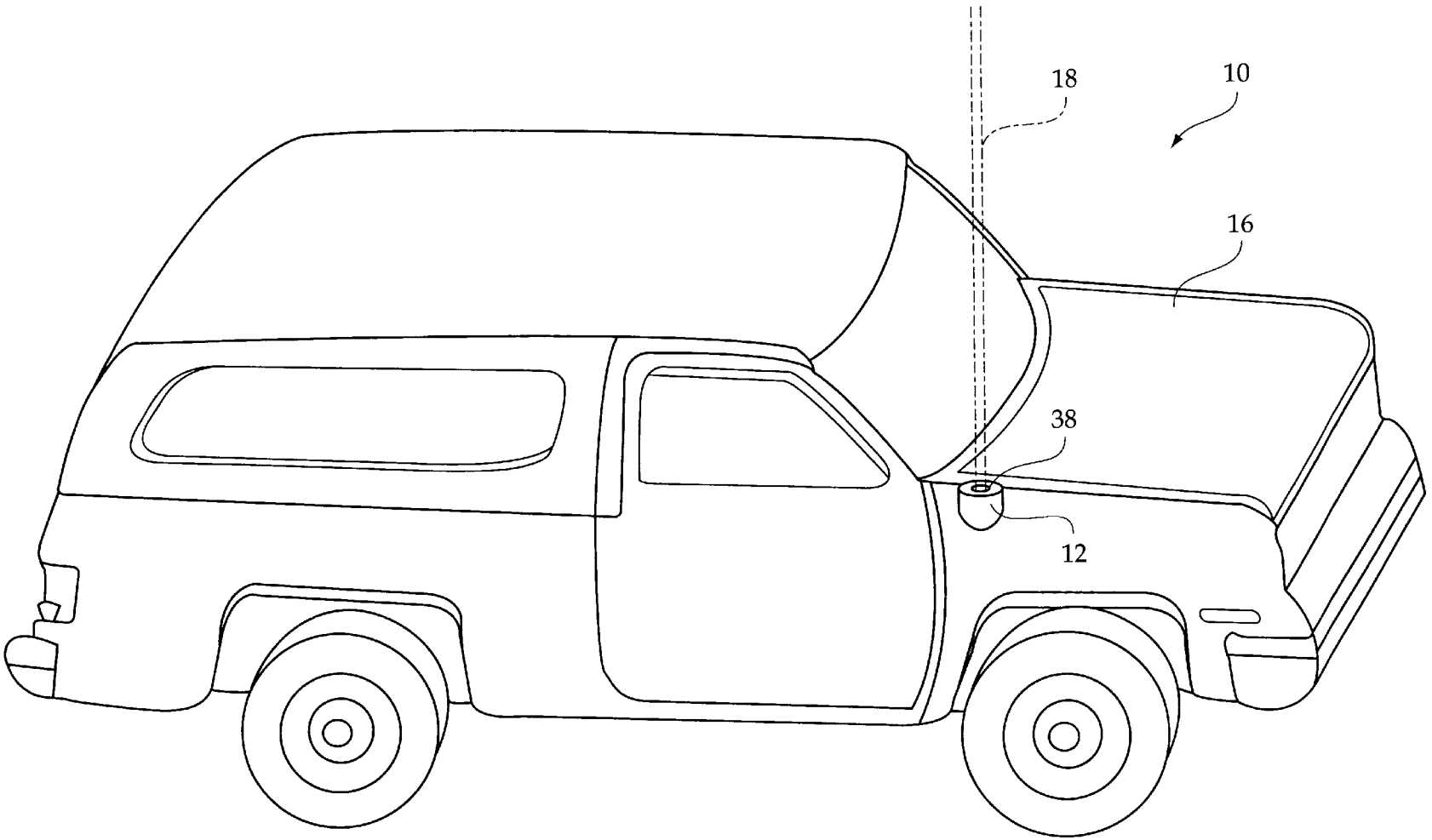
FIG. 2 is a perspective view of the present invention within an automobile.

The present invention is primarily comprised of an emitting unit 12 secured to a house 14 (FIG. 1) or a vehicle 16 (FIG. 2). The emitter unit 12 is preferably secured to the house 14 or vehicle 16 in a position that will be unobstructed, such as on the roof of the house 14 or the side of the front fender of the vehicle 16. The emitter unit 12 is in communication with an electronic medium disposed within the house 14 or vehicle 16. Although the electronic medium has been omitted from the drawings, it can be selected from group including, but not limited to, a radio, television, or a cellular telephone. The emitter unit 12 generates a laser beam 18 for projecting outwardly therefrom. The laser beam 18 collects radio frequency energy for properly operating the electronic medium. Thus, the laser beam 18 will project outwardly similar to an antenna and function in essentially the same manner, by collecting frequencies and signals for the proper operation of the electronic mediums.

Figure 3:
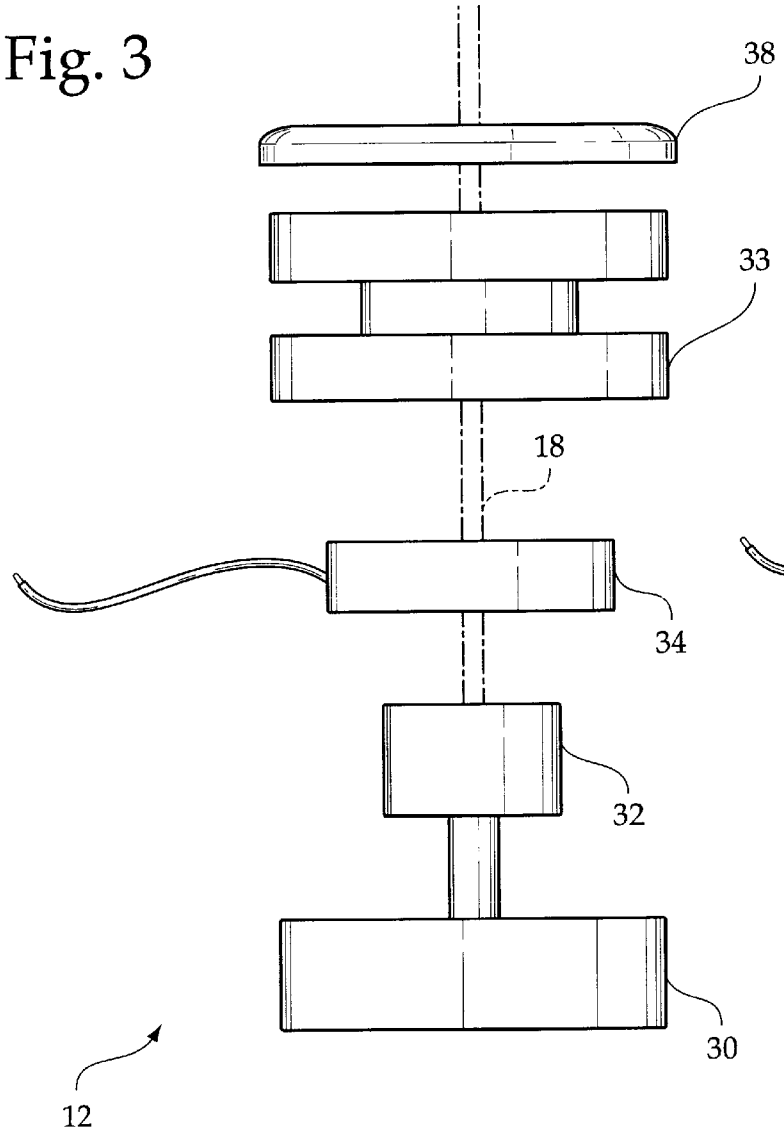
FIG. 3 is a side elevational view of the laser beam frequency collection device, per se.

Referring now to FIG. 3, the emitter unit 12, generally comprises a power supply 30, a laser diode 32, a lens 38, a collection grid 34 located between the laser diode 32 and lens 38, and a wave guide 33 located between the collection grid 34 and lens 38. The power supply 30 supplies power to the laser diode 32. The laser diode 32 generates the beam 18, which is coherent and monochromatic. The beam 18 then travels through the collection grid 34, the wave guide 33, and exits the emitter unit 12 at the lens 38.

Figure 4:
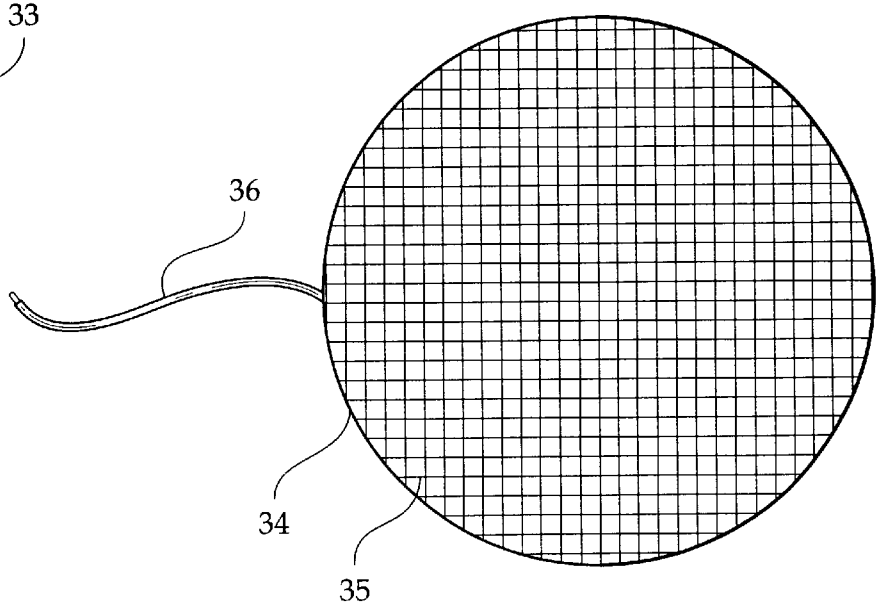
FIG. 4 is a top plan view of just the collection grid thereof.

Referring to FIG. 4, the collection grid 34 comprises a metal mesh 35, and an output lead 36. An electromagnetic signal is retrieved from the laser beam by the metal mesh 35, and is available to the electronic medium through the output lead 36.

Referring back to FIGS. 1, 2, and 3, after the laser beam 18 exits the lens 38, it exits the house, vehicle, or electronic medium such as a cellular telephone, it propagates upward or outward until it strikes another object. According to the present invention, electromagnetic energy is captured by the beam, and travels along the beam. Accordingly then, said electromagnetic energy is focused by the wave guide 33, which is a commonly available electromagnetic component used in radar systems. The electromagnetic energy is then is gathered by the metal mesh of the collection grid 34. The electromagnetic energy is harnessed thereat to provide the electromagnetic signal which is used by the electronic medium connected thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A laser beam frequency collection device for collecting radio frequency energy employed by a radio, television, cellular telephone, and or other electronic medium:

a laser diode, the laser diode producing a coherent, monochromatic beam of light;

a lens, for focusing the beam, the beam exiting the lens and propagating outward therefrom;

a collection grid, having a metal mesh, and an output lead attached thereto, the metal mesh located between the laser diode and lens, such that the beam travels through the metal mesh, and electromagnetic energy present on the beam is detectable at the output lead as an electromagnetic signal which is useable by the electronic medium.

2. The laser beam frequency collection device as recited in claim 1, wherein the metal mesh made of stainless steel.

3. The laser beam frequency collection device as recited in claim 2, further comprising a wave guide located between the collection grid and lens, the beam travelling through the wave guide.

* * * * *